US009124021B2

(12) United States Patent
Kashiwada et al.

(10) Patent No.: US 9,124,021 B2
(45) Date of Patent: Sep. 1, 2015

(54) DEVICE CONNECTOR HAVING OUTER CONDUCTOR WITH A MOLD PORTION SANDWICHED BETWEEN A BRACKET AND A HOUSING

(71) Applicant: Sumitomo Wiring Systems, Ltd., Yokkaichi, Mie (JP)

(72) Inventors: Tomokazu Kashiwada, Yokkaichi (JP); Hiroyuki Matsuoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 25 days.

(21) Appl. No.: 14/081,258

(22) Filed: Nov. 15, 2013

(65) Prior Publication Data

US 2014/0148034 A1 May 29, 2014

(30) Foreign Application Priority Data

Nov. 28, 2012 (JP) ..... 2012-259793

(51) Int. Cl.

| | |
|---|---|
| ***H01R 13/625*** | (2006.01) |
| ***H01R 13/512*** | (2006.01) |
| ***H01R 13/73*** | (2006.01) |
| *H01R 13/52* | (2006.01) |
| *H01R 13/58* | (2006.01) |

(52) U.S. Cl.

CPC ..... *H01R 13/512* (2013.01); *H01R 13/73* (2013.01); *H01R 13/5202* (2013.01); *H01R 13/5845* (2013.01)

(58) Field of Classification Search

CPC ... H01R 13/73; H01R 33/975; H01R 33/7664

USPC ..... 439/345, 352–358

See application file for complete search history.

(56) References Cited

U.S. PATENT DOCUMENTS

| | | | | |
|---|---|---|---|---|
| 8,425,256 | B2 * | 4/2013 | Aoki et al. | 439/620.26 |
| 2002/0068480 | A1 * | 6/2002 | Pfaff et al. | 439/607 |
| 2009/0137153 | A1 * | 5/2009 | Yoshioka et al. | 439/607.24 |
| 2013/0017719 | A1 * | 1/2013 | Tanaka et al. | 439/587 |
| 2013/0341086 | A1 * | 12/2013 | Kato et al. | 174/72 A |
| 2014/0120767 | A1 * | 5/2014 | Itsuki et al. | 439/587 |

FOREIGN PATENT DOCUMENTS

JP 2003-317821 11/2003

* cited by examiner

*Primary Examiner* — Chandrika Prasad

(74) *Attorney, Agent, or Firm* — Gerald E. Hespos; Michael J. Porco; Matthew T. Hespos

(57) ABSTRACT

A device connector is to be connected to a device and includes male terminals (21) to be connected to female terminals in the device, Shield cables (90) are pulled out in a direction different from a connecting direction to the female terminals. An inner conductor (50) electrically conductively connects the male terminals (21) and the shield cables (90). A mold portion (80) is formed by molding the shield cables (90) with resin. A rear bracket (70) immovably fixes the housing (10) to a case of the device. A housing (10) has the inner conductor (50) accommodated inside, and a seal ring (82) seals between the mold portion (80) and the housing (10). The mold portion (80) is sandwiched between the rear bracket (70) and the housing (10) in a pull-out direction of the shield cables (90).

7 Claims, 13 Drawing Sheets

DEVICE CONNECTOR HAVING OUTER CONDUCTOR WITH A MOLD PORTION SANDWICHED BETWEEN A BRACKET AND A HOUSING

BACKGROUND

1. Field of the Invention

The invention relates to a device connector.

2. Description of the Related Art

Japanese Unexamined Patent Publication No. 2003-317821 discloses a device connector to be mounted on a case of a device. The device connector includes a device connecting portion to be connected to a device-side terminal provided in a device. An outer conductor is pulled out in a direction different from a connecting direction to the device-side terminal. An inner conductor electrically connects the device connecting portion and the outer conductor. A housing accommodates the inner conductor inside and rubber plug is mounted on a part of the housing where the outer conductor is pulled out and is retained by a retainer.

The retainer is not fixed firmly to the housing. Thus, vibration cannot be blocked reliably when the outer conductor vibrates, and contact portions of the device-side terminal and the device connecting portion may slide on each other.

The invention was completed in view of the above situation and aims to protect contact portions of a device-side terminal and a device connecting portion by reducing vibration of an outer conductor.

SUMMARY OF THE INVENTION

The invention relates to a device connector to be connected to a device. The device connector includes a device connecting portion to be connected to a device-side conductor provided in the device. An outer conductor is pulled out in a direction different from a connecting direction to the device-side conductor and an inner conductor electrically conductively connects the device connecting portion and the outer conductor. The inner conductor is accommodated in a housing; a mold portion formed by molding the outer conductor with resin; and a bracket immovably fixes the housing to a case of the device. At least part of the mold portion is sandwiched between the bracket and the housing in a pull-out direction of the outer conductor. Thus, the mold portion reliably protects the contacts of the device-side terminal from vibration when the shield cable vibrates in the pull-out direction thereof.

The device connector may further comprise a seal for sealing between the mold portion and the housing. The seal prevents water from entering the housing.

The mold portion may be immovably fixed to the bracket. Thus, the vibration of the outer conductor is blocked reliably in directions other than the pull-out direction of the outer conductor.

The outer conductor preferably is a shield cable in which a shield layer is arranged around a core. The shield layer may be a braided wire.

The mold portion may be formed by integrally molding the shield cable and a shield plate connected to the shield layer.

The mold portion preferably is fixed immovably to the bracket by connecting the shield plate to the bracket. The bracket preferably is electrically conductive. According to such a configuration, the shield plate and the case of the device can be electrically conductively connected via the bracket. Thus, shield performance can be improved.

Two shield cables may be juxtaposed in the mold portion, and the mold portion may be fixed to the bracket in a dead space between the shield cables.

These and other features of the invention will become more apparent upon reading of the following detailed description of preferred embodiments and accompanying drawings. It should be understood that even though embodiments are described separately, single features may be combined to additional embodiments.

DETAILED DESCRIPTION OF THE PREFERRED EMBODIMENTS

Figure 6:
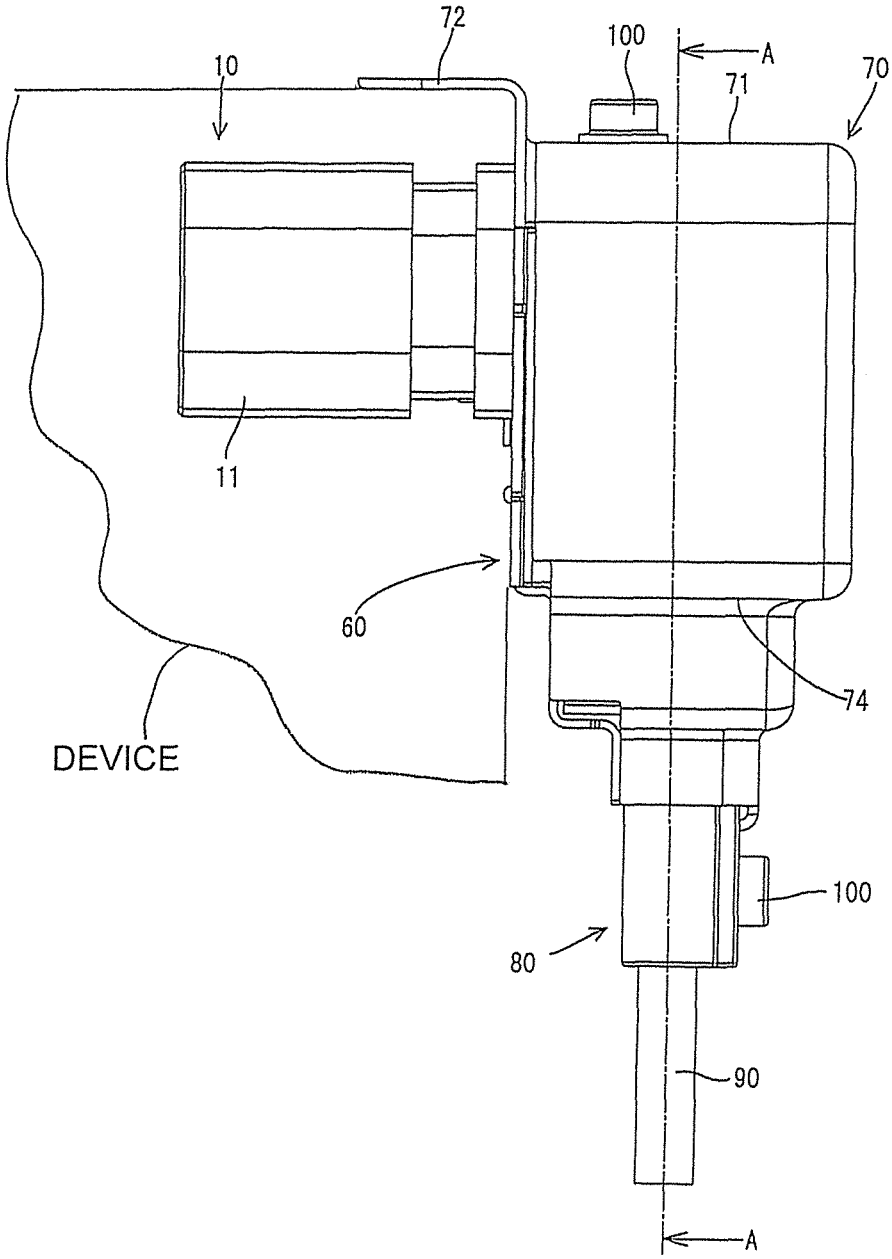
FIG. 6 is a right side view of the device connector.
Figure 7:
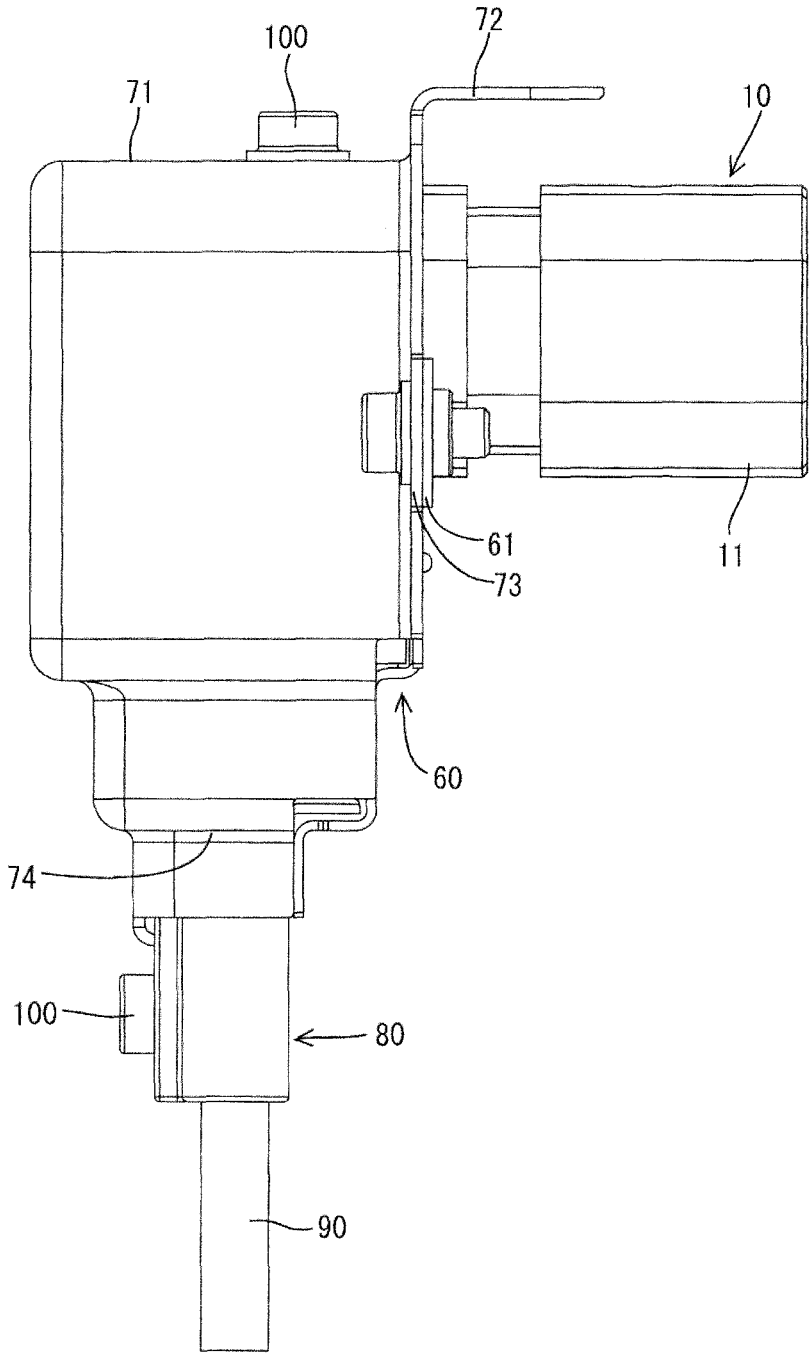
FIG. 7 is a left side view of the device connector.

A device connector in accordance with the invention includes a housing 10 made e.g. of synthetic resin, a terminal accommodating portion 20, a fuse 30, a heat radiating rubber portion 40, an inner conductor 50, an electrically conductive front bracket 60, a rear bracket 70, a mold 80, one or more shield cables 90, etc. The device connector is fittable into a mounting hole of a case of a device 100, as shown in FIG. 6.

Figure 11:
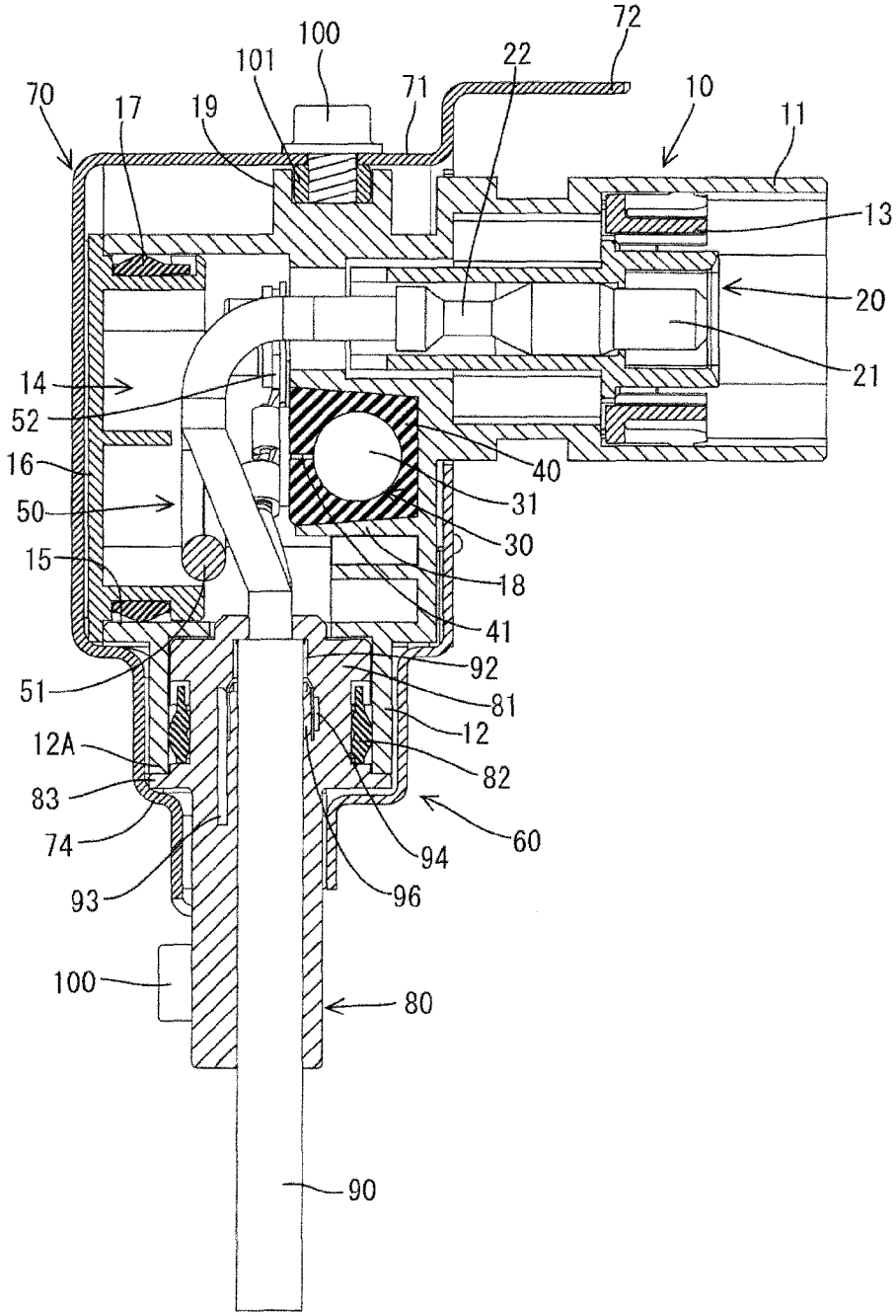
FIG. 11 is a section along C-C of FIG. 10.

The housing 10 includes a fitting 11 that can fit into the mounting hole of the device and a mounting portion 12 on which the mold portion 80 is to be mounted. A fitting direction of the fitting portion 11 into the mounting hole and a mounting direction of the mold portion 80 to the mounting portion 12 are substantially perpendicular. As shown in FIG. 11, the fitting 11 has a forwardly open receptacle and the mounting portion 12 has a downwardly open receptacle. The terminal accommodating portion 20 is accommodated into the fitting 11 from the front, and a holder 13 prevents detachment of the terminal accommodating portion 20. A resilient or rubber ring 11A is mounted on the outer peripheral surface of the fitting.

An accommodation space 14 is formed between the fitting 11 and the mounting portion 12 of the housing 10 and accommodates the inner conductor 50, the fuse 30, etc. inside. The accommodation space 14 communicates with the inner spaces of both the fitting portion 11 and the mounting portion 12. A service hole 15 is open on a rear wall forming the accommodation space 14 and is closed by a service cover 16. The service cover 16 includes a tubular portion to be fit into the service hole 15, and a rubber ring 17 is mounted on the outer peripheral surface of the tubular portion to prevent water from entering through the service hole 15 and into the accommodation space 14.

A fuse mounting portion 18 is formed in the accommodation space 14 in which the fuse 30 and the heat radiating rubber portion 40 are to be at least partly mounted. This fuse mounting portion 18 is open rearward and has an inclined inner surface formed to increase a vertical dimension toward the back. The fuse 30 particularly includes a substantially cylindrical fuse main body 31 and two fuse electrodes 32 formed respectively on opposite ends of the fuse main body 31. The fuse main body 31 has a known structure as a fuse and generates heat due to the flow of electricity.

The heat radiating rubber portion 40 is molded from a resilient material e.g. rubber and is mounted in the fuse mounting portion 18 while fit closely around the fuse main body 31. Further, the heat radiating rubber portion 40 closely contacts both the fuse main body 31 and the fuse mounting portion 18. Thus, the heat radiating rubber portion 40 fills out an air layer that would otherwise be formed between the fuse main body 31 and the fuse mounting portion 18. As a result, the heat radiating rubber portion 40 forms a heat-bridge between the fuse 30 and the housing 10 and has a higher thermal conductivity than air so that heat generated in the fuse main body 31 is transferred efficiently to the fuse mounting portion 18 via the heat radiating rubber portion 40. The heat transferred to the fuse mounting portion 18 is transferred to the rear bracket 70 from the outer surface of the housing 10 and further to the case of the device.

The heat radiating rubber portion 40 has a slit 41 formed by cutting the heat radiating rubber portion 40 radially out from the inner surface of an accommodation hole that accommodates the fuse main body 31. The slit 41 can be widened resiliently so that the heat radiating rubber portion 40 can be fit around the fuse main body 31 so that the fuse main body 31 is covered by the heat radiating rubber portion 40. Thus, the heat radiating rubber portion 40 is mounted easily on the fuse main body 31 merely by opening the slit 41.

Figure 8:
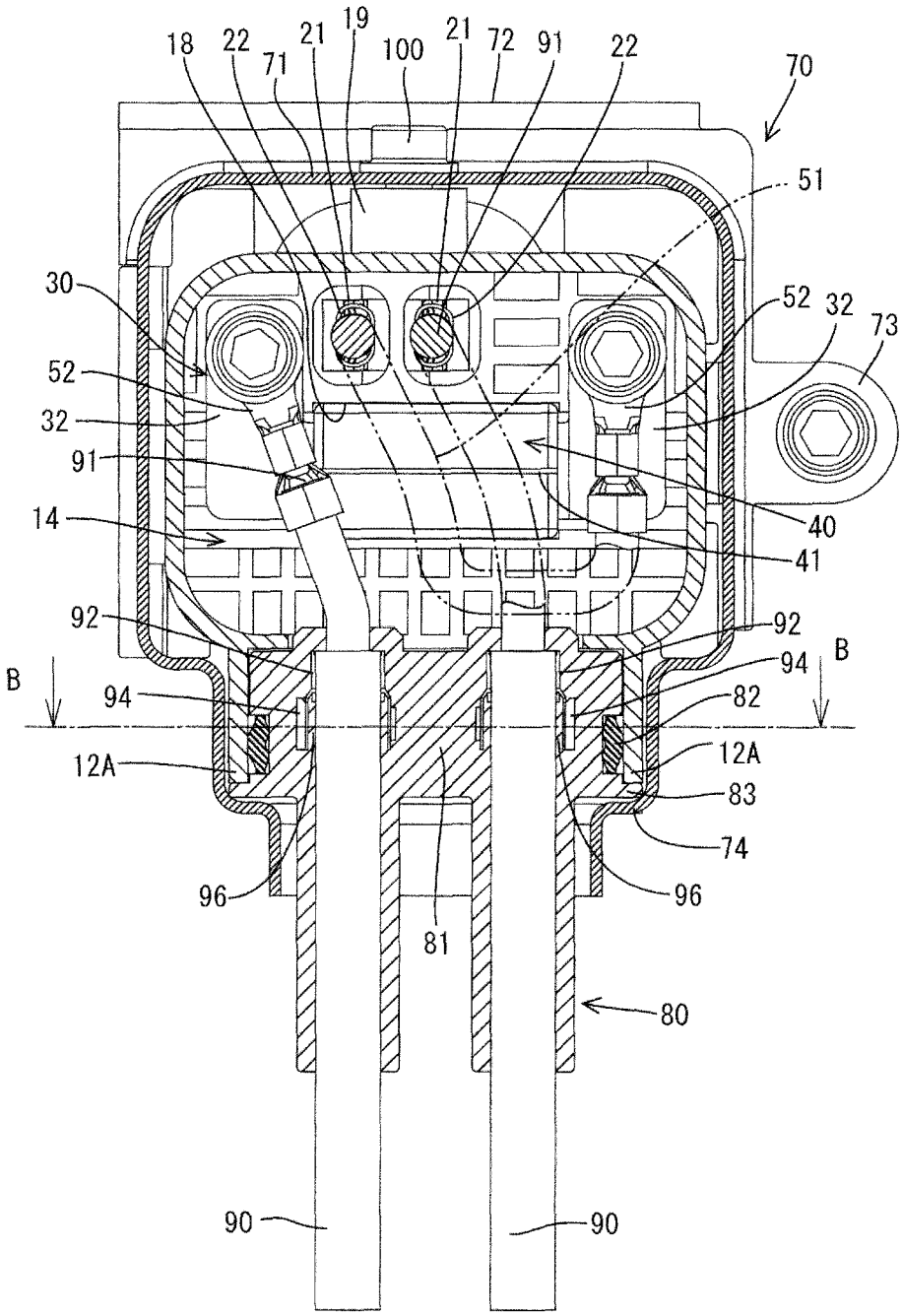
FIG. 8 is a section along A-A of FIG. 6.
Figure 10:
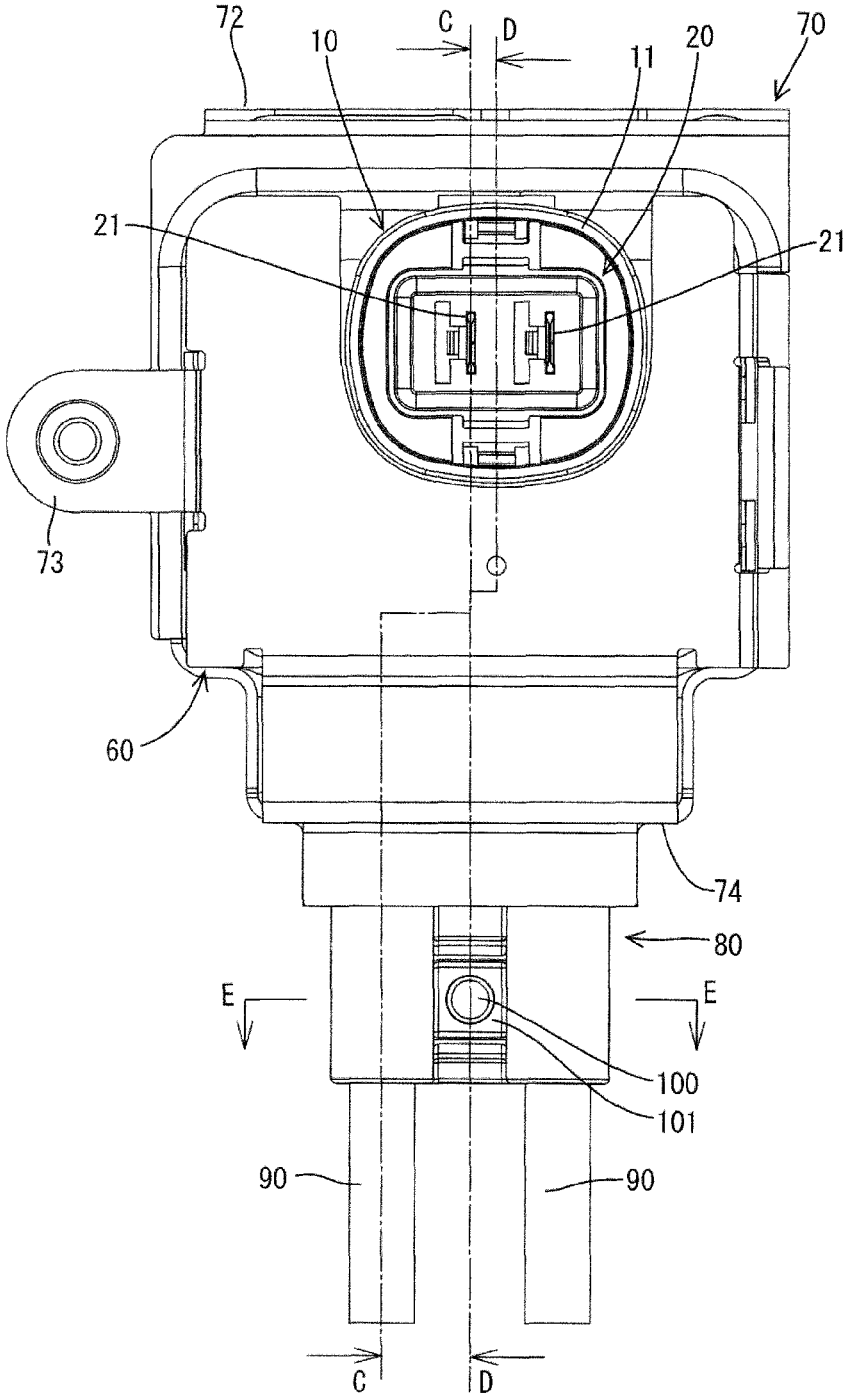
FIG. 10 is a front view of the device connector.

As shown in FIG. 11, male terminals 21 are accommodated in the terminal accommodating portion 20. The male terminals 21 can be connected to female terminals (not shown) provided in the device. Specifically, the male terminals 21 are tabs arranged laterally side by side and in a vertical orientation as shown in FIG. 10. One of the male terminals 21 is connected directly to one shield cable 90, as shown in FIG. 8, but the other male terminal 21 is connected to the other shield cable 90 via the inner conductor 50, the fuse electrodes, 32 and the fuse 30. The inner conductor 50 includes an inner wire 51 connected to an end of the male terminal 21 and two substantially round terminals 52 respectively connected to the fuse 30 and the fuse electrodes 32. In other words, the fuse 30 is arranged at an intermediate position of a conductive path of the inner conductor 50.

Figure 9:
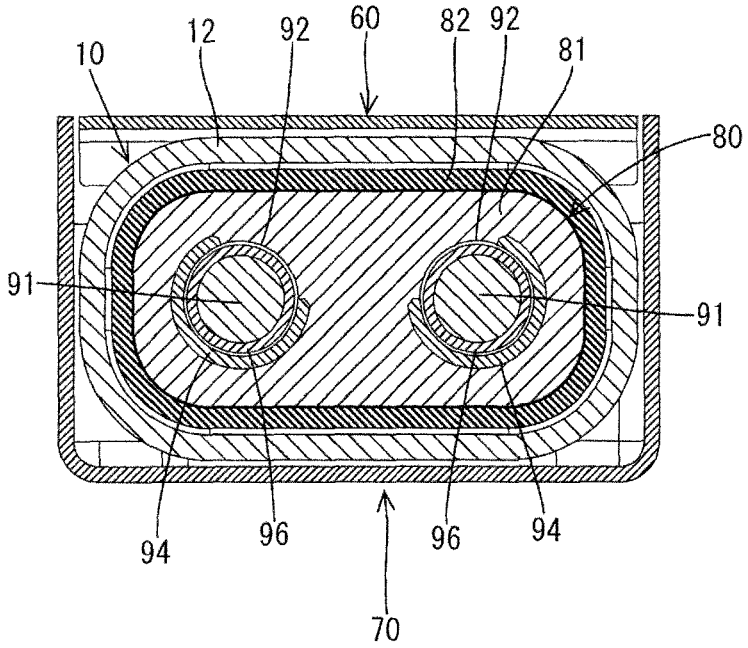
FIG. 9 is a section along B-B of FIG. 8.

The shield cable 90 is configured such that a braided wire 92 or other shield layer is arranged around a core 91 and insulating resin is arranged between the core 91 and the braided wire 92. Two shield cables 90 are arranged substantially adjacent to each other, and the respective braided wires 92 are connected together to a shield plate 93. Specifically, as shown in FIG. 9, an underlay ring 96 is to be mounted on the outer periphery of the shield cable 90, the braided wire 92 is arranged on the outer periphery of this underlay ring 96 and the braided wire 92 is caulked or sandwiched between a barrel piece 94 of the shield plate 93 and the underlay ring 96.

Figure 12:
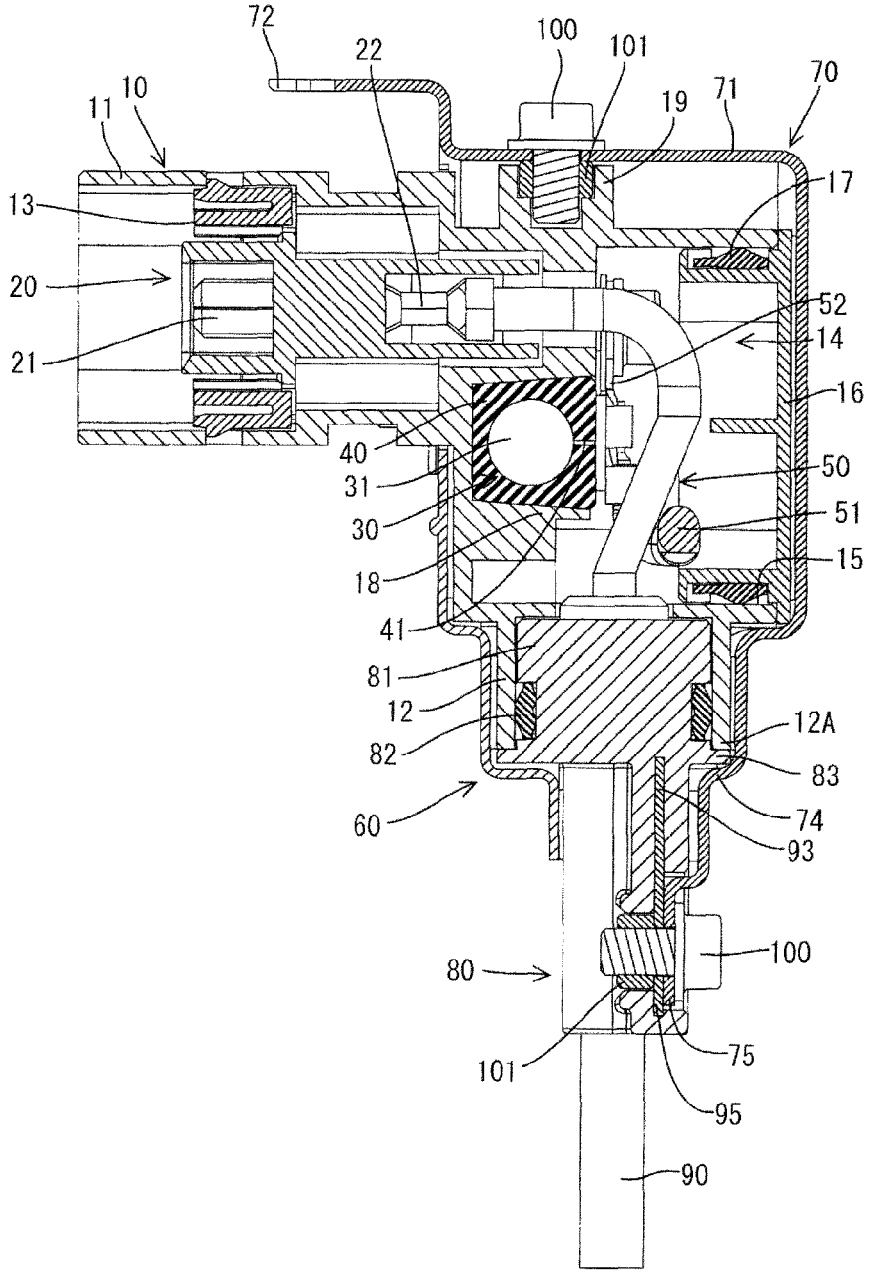
FIG. 12 is a section along D-D of FIG. 10.
Figure 13:
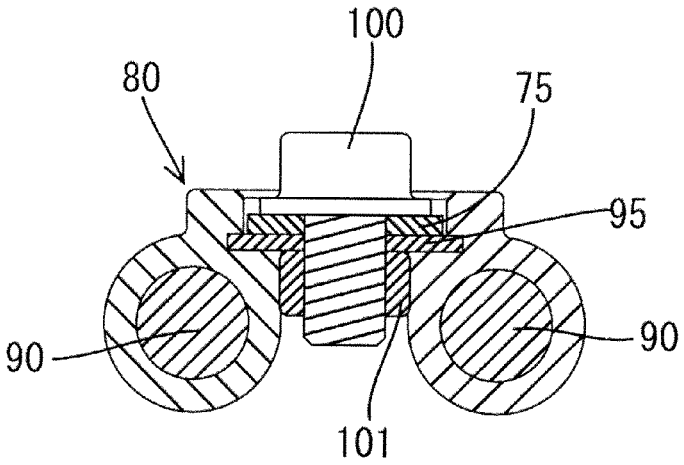
FIG. 13 is a section along E-E of FIG. 10.

The mold portion 80 is formed by molding the shield cables 90 and shield plate 93 with resin. The mold portion 80 has a shaft 81 that can be fit in the mounting portion 12 and a seal ring 82 is mounted on the outer periphery of a shaft 81. Thus, the seal ring 82 is sandwiched between the outer peripheral surface of the shaft 81 and the inner peripheral surface of the mounting portion 12 to prevent fluid from entering the housing 10 through the mounting portion 12. The barrel pieces 94 of the shield plate 93 are molded in the shaft 81. Further, as shown in FIG. 12, a bracket connecting portion 95 of the shield plate 93 is exposed below or from the shaft 81 and is at least partly between the shield cables 90.

As shown in FIG. 11, the rear bracket 70 is made of an electrically conductive metal plate and is mounted along the outer surface of the housing 10 to at least partly cover the housing 10 in a range from the rear surface to the upper surface. At least one boss 19 projects up on the upper surface of the housing 10 and a nut 101 is press-fit into the boss 19, and the rear bracket 70 is fixed to the housing 10 by tightening a bolt 100 while sandwiching a ceiling wall 71 of the rear bracket 70 between the bolt 100 and the nut 101. An attaching portion 72 projects forward from the front edge of the ceiling wall 71 of the rear bracket 70 and is to be bolt-fastened to the case of the device.

Figure 1:
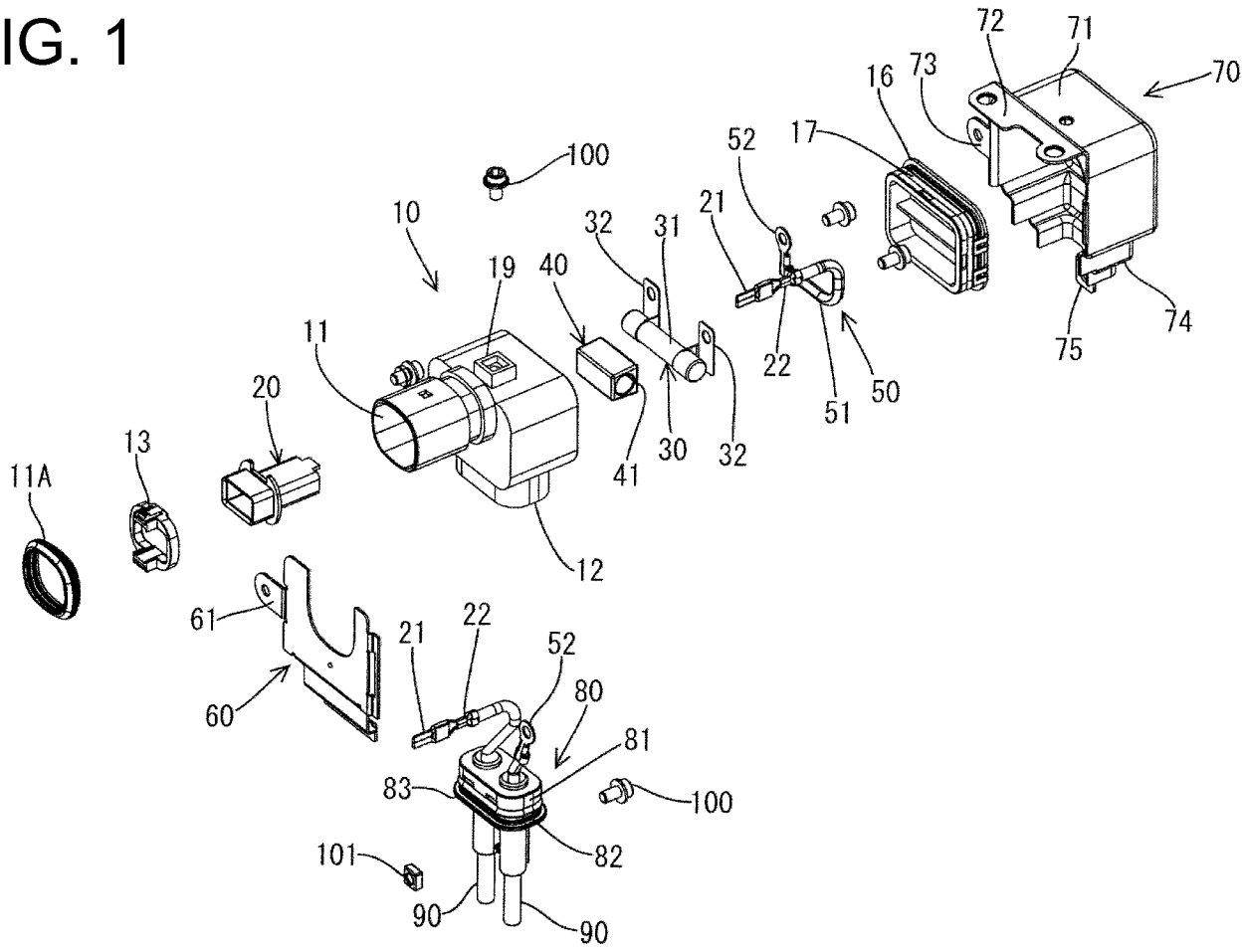
FIG. 1 is an exploded perspective view of a device connector.
Figure 2:
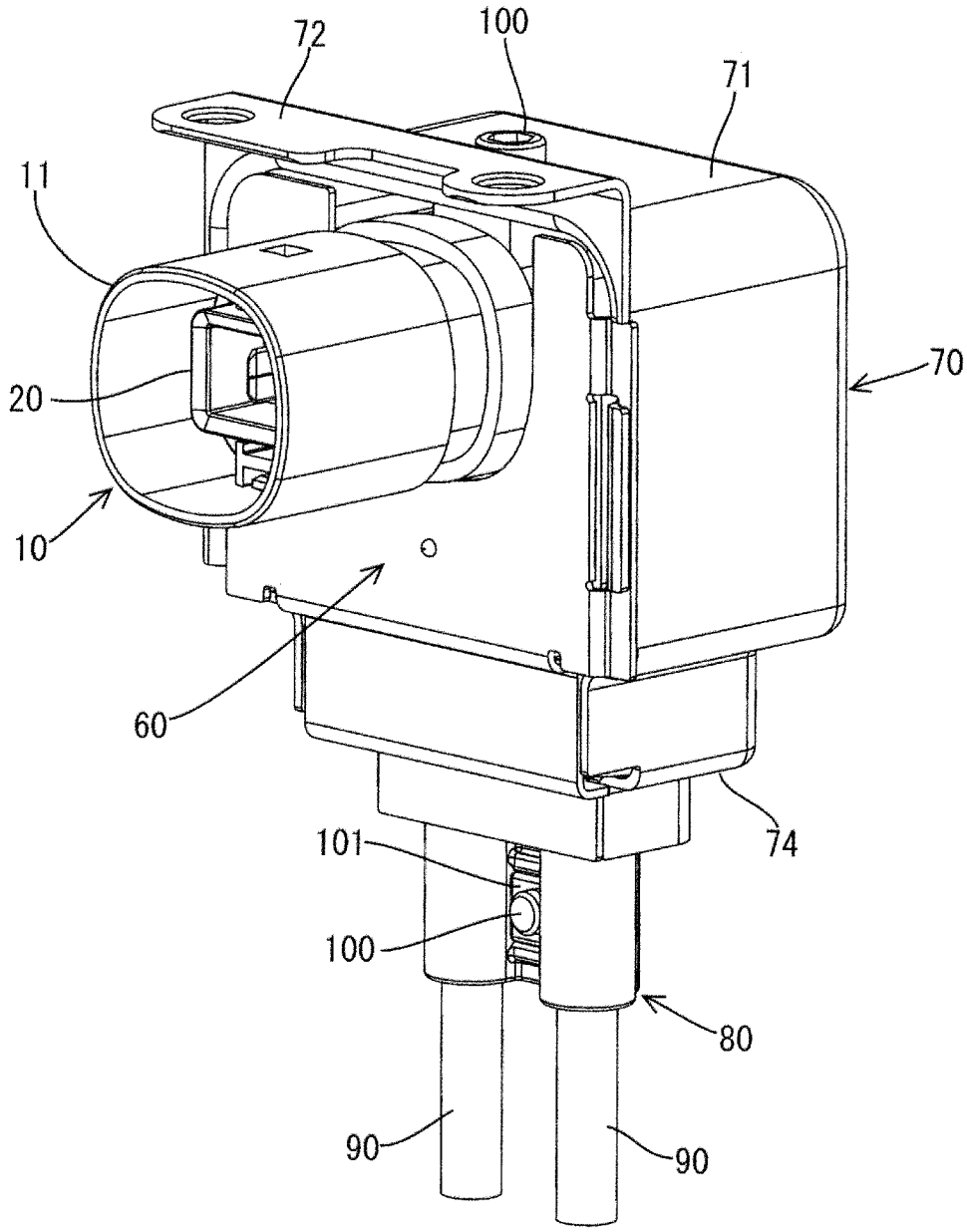
FIG. 2 is a front perspective view of the device connector.
Figure 3:
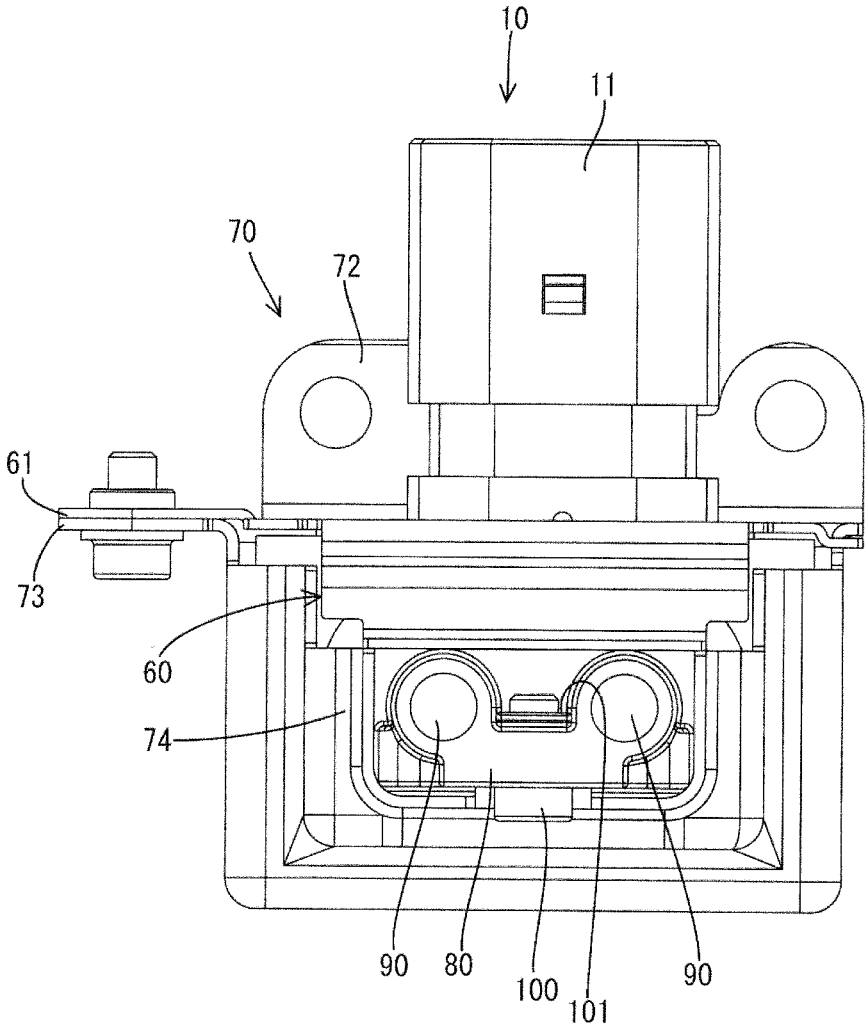
FIG. 3 is a bottom view of the device connector.
Figure 4:
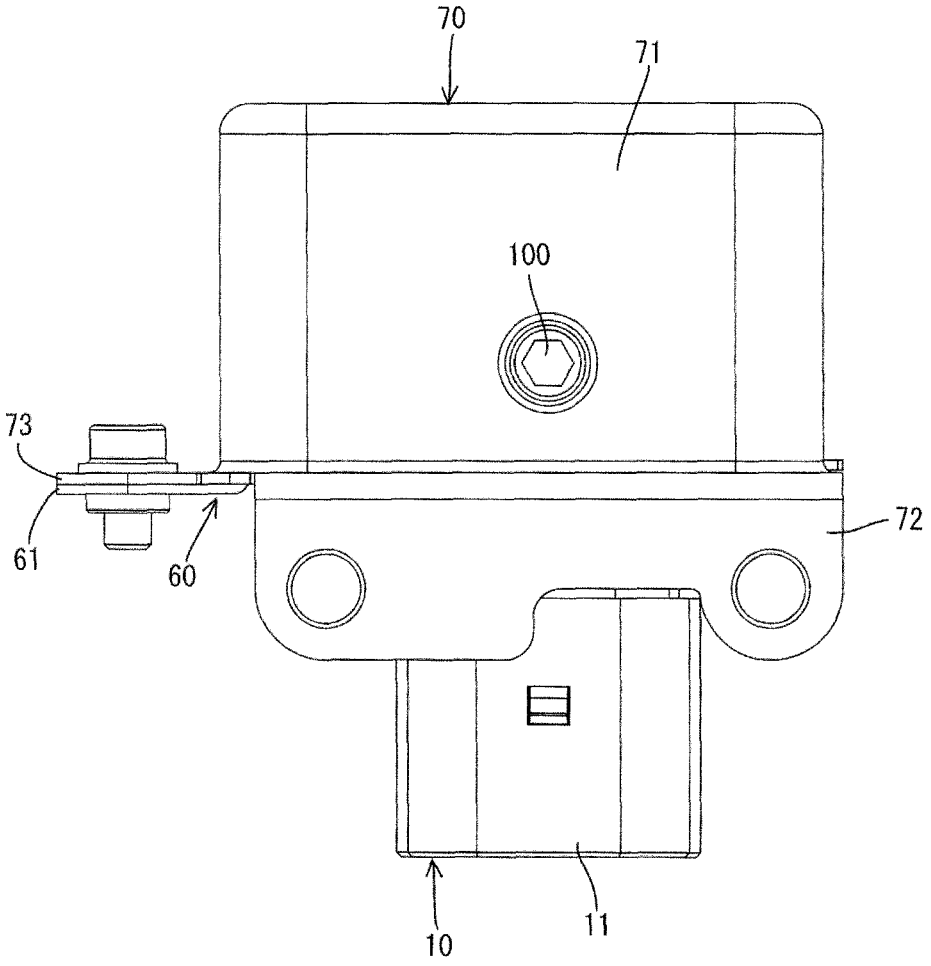
FIG. 4 is a plan view of the device connector.
Figure 5:
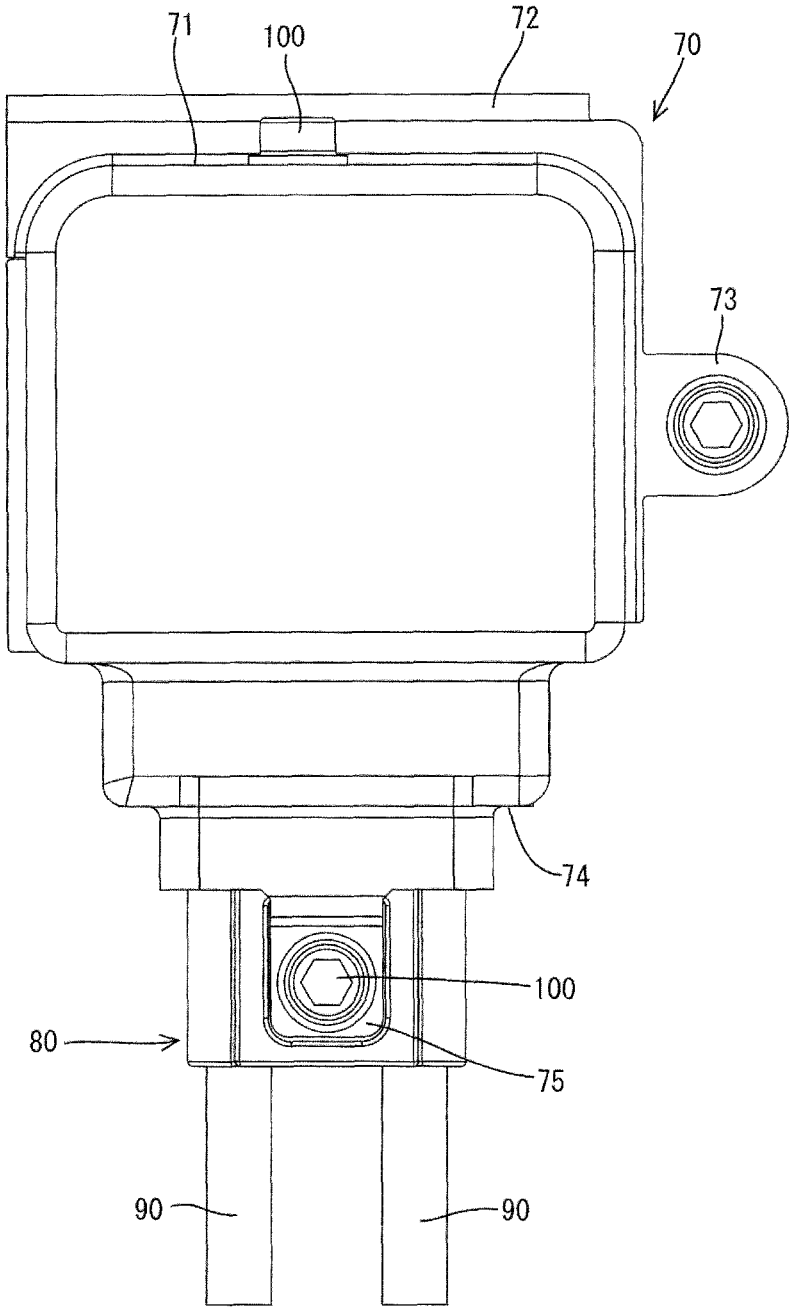
FIG. 5 is a rear view of the device connector.

The front bracket 60 includes a cut for the escape of the fitting 11, and is mounted substantially along the outer surface of the housing 10 to cover the front surface of the housing 10 excluding the fitting 11. As shown in FIGS. 3 and 4, the front bracket 60 and the rear bracket 70 each include a protrusion 61, 73 that protrudes laterally, and both brackets 60, 70 are connected to each other by bolt-fastening the protrusions 61, 73.

As shown in FIG. 11, an outer rib 83 is provided around the outer periphery of the mold portion 80 and contacts an opening edge 12A of the mounting portion 12 from below. Further, a part of the rear bracket 70 adjacent and below the mounting portion 12 is formed into a step 74 that contacts the outer rib 83 from below. The outer rib 83 is sandwiched vertically in a pull-out direction of the shield cables 90 between the opening edge 12A of the mounting portion 12 and the step 74. Thus, the mold portion 80 is fixed so as not to move vertically relative to the housing 10. Thus, any vibration transferred from the shield cables 90 in the pull-out direction of the shield cable 90 is blocked by the mold portion 80.

A fastening seat 75 is formed on a lower part of the rear bracket 70, as shown in FIG. 12, and is bolt-fastened to the bracket connecting portion 95. Further, a nut 101 is press-fit at a position of the mold portion 80 corresponding to the bracket connecting portion 95. The fastening seat 75 and the bracket connecting portion 95 are fastened while being sandwiched between a bolt 100 and the nut 101 to fix the mold portion 80 to the rear bracket 70. In this way, the mold portion 80 is fixed so as not to move relative to the housing 10, including in directions other than the pull-out direction of the shield cables 90. Simultaneously, the braided wires 92 are shield-connected to the case of the device via the shield plate 93 and the rear bracket 70 to improve shield performance.

The underlay ring 96 is mounted on the shield cables 90 in advance. The braided wires 92 then are exposed by applying peeling to ends of the shield cables 90 and are folded back to fit on the outer periphery of the underlay ring 96. The barrel pieces 94 of the shield plate 93 then are caulked and fixed to the braided wires 92. The shield cables 90 connected to the shield plate 93 then are set in a forming mold and molded with resin to form the mold portion 80. The seal ring 82 is mounted on the shaft 81 of the mold portion 80 and the shaft 81 is fitted into the mounting portion 12 of the housing 10.

On the other hand, the terminal accommodating portion 20 is mounted into the fitting 11 of the housing 10 from the front and the holder 13 is mounted therein from the front to fix the terminal accommodating portion 20 in the fitting 11. The slit 41 of the heat radiating rubber portion 40 is opened and the heat radiating rubber portion 40 is fit on the fuse main body 31 of the fuse 30. The resulting assembly then is pushed into the fuse mounting portion 18. In this way, the heat radiating rubber portion 40 is disposed to fill the air layer between the fuse main body 31 and the fuse mounting portion 18 and closely contacts both the fuse main body 31 and the fuse mounting portion 18.

Subsequently, as shown in FIG. 8, the core 91 of the right shield cable 90 is crimped, bent or folded to the barrel 22 of the male terminal 21, and the male terminal 21 is inserted into the terminal accommodating portion 20 from behind. On the other hand, the round terminal 52 is crimped to the core 91 of the left shield cable 90 and bolt-fastened to the left fuse electrode 32. Further, the male terminal 21 and the round terminal 52 are crimped respectively to opposite ends of the inner wire 51, the round terminal 52 is bolt-fastened to the right fuse electrode 32, and the male terminal 21 is inserted into the terminal accommodating portion 20 from behind. Thereafter, the service cover 16 is mounted at the service hole 15 to seal the accommodation space 14 of the housing 10.

The front bracket 60 is mounted on the front surface of the housing 10, the rear bracket 70 is mounted on the upper and rear surfaces of the housing 10, and the protrusions 61, 73 of the respective brackets 60, 70 are bolt-fastened. In this way, the brackets 60, 70 are formed into an integral bracket and mounted on the outer surfaces of the housing 10 excluding the fitting 11. Thus, heat generated in the fuse 30 is transferred to the case of the device via the heat radiating rubber portion 40, the housing 10 and the respective brackets 60, 70 and does not stay in the housing 10.

The rear bracket 70 is fixed to the housing 10 by tightening the bolt 100 into the nut 101 press-fit into the boss 19 of the housing 10, and the fastening seat 75 and the bracket connecting portion 95 are fixed conductively by tightening the bolt 10 into the nut 101. The fitting 11 of the housing 10 then is inserted into the mounting hole in the case of the device. The attaching portion 72 of the rear bracket 70 then is bolt-fastened to the case of the device so that the rear bracket 70 and the case are fixed electrically conductively. Thus, vibration transferred from the shield cables 90 is blocked by the mold portion 80 and does not affect contact portions of the male terminals 21 and the female terminals.

As described above, the mold portion 80 is sandwiched between the step 74 of the rear bracket 70 and the opening edge 12A of the mounting portion 12 of the housing 10. Thus, the mold portion 80 can be fixed immovably in the pull-out direction of the shield cables 90. Thus, when the shield cables 90 vibrate in the pull-out direction, that vibration can be blocked reliably or reduced significantly by the mold portion 80 and the contacts of the female terminals and the male terminals 21 can be protected. Further, the seal ring 82 prevents fluid or water from entering into the housing 10.

The mold portion 80 may be fixed immovably to the rear bracket 70. Accordingly, since the mold portion 80 can be fixed to the housing 10 via the rear bracket 70, vibration of the shield cables 90 also can be blocked or reduced in directions other than the pull-out direction of the shield cables 90.

Each shield cable 90 is configured so that the braided wire 92 is arranged around the core 91, and the mold portion 80 is formed by integrally molding the shield cables 90 and the shield plate 93 connected to the braided wires 92. The mold portion 80 may be immovably fixed to the rear bracket 70 by connecting this shield plate 93 to the electrically conductive rear bracket 70. Thus, the shield plate 93 and the case of the device can be connected electrically conductively via the rear bracket 70. Thus, shield performance can be improved.

The shield cables 90 may be juxtaposed in the mold portion 80 and the mold portion may be fixed to the rear bracket 70 between the pair of shield cables 90. According to such a configuration, the shield cables 90 can be fixed together to the rear bracket 70 via the shield plate 93. Further, the mold portion 80 can be fixed to the rear bracket 70 utilizing a dead space formed between the shield cables 90.

The invention is not limited to the above described embodiment. For example, the following embodiments also are included in the scope of the invention.

The outer rib 83 of the mold portion 80 is sandwiched between the step 74 of the rear bracket 70 and the opening edge 12A of the mounting portion 12 in the above embodiment. However, the shaft 81 of the mold portion 80 may be sandwiched between the back wall of the mounting portion 12 and the step 74.

The fastening seat 75 of the rear bracket 70 and the bracket connecting portion 95 of the shield plate 93 are bolt-fastened in the above embodiment. However, the mold portion 80 may be fixed immovably to the rear bracket 70 e.g. by press-fitting the shaft 81 of the mold portion 80 into the mounting portion 12.

An individual core shielding structure is adopted by individually shielding the shield cables 90 in the above embodiment. However, a collective shielding structure may be adopted by collectively shielding two wires according to the invention.

What is claimed is:

1. A device connector to be connected to a device, comprising:

a housing to be connected to the device in a connecting direction;

a bracket for immovably fixing the housing to the device;

a device connecting portion mounted in the housing and extending in the connecting direction;

at least one outer conductor pulled out of the housing in a direction different from the connecting direction;

an inner conductor electrically conductively connecting the device connecting portion and the at least one outer conductor, the inner conductor being accommodated at least partly in the housing; and a mold portion formed by molding the at least one outer conductor with resin, the mold portion being sandwiched at least partly between the bracket and the housing in a pull-out direction of the at least one outer conductor.

2. The device connector of claim 1, further comprising a seal for sealing between the mold portion and the housing.

3. The device connector of claim 1, wherein the mold portion is fixed immovably to the bracket.

4. The device connector of claim 1, wherein the at least one outer conductor is at least one shield cable in which a shield layer is arranged around a core.

5. The device connector of claim 4, wherein the mold portion is formed by integrally molding the at least one shield cable and a shield plate connected to the shield layer.

6. The device connector of claim 5, wherein the mold portion is immovably fixed to the bracket by connecting the shield plate to the bracket.

7. The device connector of claim 6, wherein the at least one shield cable comprises two shield cables substantially juxtaposed in the mold portion, and the mold portion is fixed to the bracket substantially between the two shield cables.

* * * * *